US008840216B2

(12) United States Patent
Hamamoto

(10) Patent No.: US 8,840,216 B2
(45) Date of Patent: Sep. 23, 2014

(54) IMAGE RECORDING DEVICE, AND IMAGE RECORDING METHOD

(71) Applicant: Seiko Epson Corporation, Tokyo (JP)

(72) Inventor: Seiko Hamamoto, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 32 days.

(21) Appl. No.: 13/686,211

(22) Filed: Nov. 27, 2012

(65) Prior Publication Data

US 2013/0141485 A1 Jun. 6, 2013

(30) Foreign Application Priority Data

Dec. 2, 2011 (JP) ..... 2011-264589

(51) Int. Cl.
*B41J 29/38* (2006.01)
*B41J 15/16* (2006.01)

(52) U.S. Cl.
CPC ..... *B41J 15/16* (2013.01); *B41J 15/165* (2013.01)
USPC ..... 347/16

(58) Field of Classification Search
CPC .... B41J 15/16; G03G 15/652; B15H 23/1888
USPC ..... 347/16
See application file for complete search history.

(56) References Cited

U.S. PATENT DOCUMENTS

2003/0234851 A1* 12/2003 Booth et al. ..... 347/104
2008/0031655 A1* 2/2008 Kondo ..... 399/123
2011/0149003 A1* 6/2011 Kondo ..... 347/104

FOREIGN PATENT DOCUMENTS

JP 10-086472 A 4/1998

* cited by examiner

*Primary Examiner* — Stephen Meier
*Assistant Examiner* — Alexander D Shenderov
(74) *Attorney, Agent, or Firm* — Global IP Counselors, LLP

(57) ABSTRACT

An image recording device comprising: a transport unit that transports a recording medium from a first drive roller to a second drive roller by rotating the first drive roller and the second drive roller across which a recording medium is stretched, a detection unit that detects tension of the recording medium between the first drive roller and the second drive roller, a support member that supports the recording medium between the detection unit and the second drive roller, a recording unit that ejects liquid on the recording medium supported on the support member and records an image, and a control unit that gives tension to the recording medium by controlling the torque of the second drive roller based on the recording medium tension detected by the detection unit.

8 Claims, 2 Drawing Sheets

IMAGE RECORDING DEVICE, AND IMAGE RECORDING METHOD

CROSS-REFERENCE TO RELATED APPLICATIONS

This application claims priority to Japanese Patent Application No. 2011-264589 filed on Dec. 2, 2011. The entire disclosure of Japanese Patent Application No. 2011-264589 is hereby incorporated herein by reference.

BACKGROUND

1. Technical Field

This invention relates to technology for recording images on a recording medium using a recording unit while transporting the recording medium.

2. Background Technology

Noted in Patent Document 1 is a recording device for spraying ink from a printing unit arranged between a paper transport unit and a paper puller unit to record an image on a continuous form transported from the paper transport unit to the paper puller unit. Both the paper transport unit and the paper puller unit are equipped with a drive roller (transport roll 9a, 13a) connected to a motor, and when each drive roller receives drive force from the motor and rotates, the recording medium (continuous form) stretched across these drive rollers is transported along the transport path. At this time, the paper feed volume of the downstream side drive roller is set to be slightly greater than the paper feed volume of the upstream side drive roller in the transport path. In other words, the circumferential velocity of the downstream side drive roller is slightly faster than the circumferential velocity of the upstream side drive roller, and by pulling the recording medium using the downstream side drive roller, tension is given to the recording medium.

Japanese Laid-open Patent Publication No. H10-086472 (Patent Document 1) is an example of the related art.

SUMMARY

Problems to be Solved by the Invention

However, as with the recording device noted above, with a constitution which gives tension to the recording medium by providing a velocity difference to the circumferential velocity of the two drive rollers, there were cases when slipping occurred between the drive roller and the recording medium, and the recording medium tension fluctuated. As a result, there was the risk that it would not be possible to do stable transporting of the recording medium, that the ink impact position on the recording medium would fluctuate, and that it would not be possible to record the image on the recording medium with sufficient positional precision.

The present invention was created considering the problems noted above, and an advantage is to provide technology capable of suppressing the fluctuation of the tension of the recording medium, and recording an image on a recording medium with high positional precision.

Means Used to Solve the Above-Mentioned Problems

To achieve the advantage noted above, the image recording device of the invention is equipped with a transport unit that, by rotating a first drive roller and a second drive roller across which a recording medium is stretched, transports the recording medium from the first drive roller to the second drive roller, a detection unit for detecting the tension of the support member between the first drive roller and the second drive roller, a support member that supports the recording medium between the detection unit and the second drive roller, a recording unit that ejects a liquid on a recording medium supported on the support member and records an image, and a control unit that gives tension to the recording medium by controlling the torque of the second drive roller based on the tension of the recording medium detected by the detection unit.

To achieve the advantage noted above, the image recording method of the invention is an image recording method for which liquid is ejected on a recording medium transported from the first drive roller to the second drive roller by rotating the first drive roller and the second drive roller across which the recording medium is stretched to record an image, and is characterized in that tension is given to the recording medium by controlling the torque of the second drive roller based on the detection results of the tension of the recording medium at a detection position between the first drive roller and the second drive roller, and liquid is ejected on the recording medium supported by the support member between from the detection position to the second drive roller to record an image.

The invention constituted in this way (image recording device, image recording method) transports a recording medium from the first drive roller to the second drive roller by rotating the first drive roller and the second drive roller across which the recording medium is stretched. Then, by controlling the torque of the second drive roller, tension is given to the recording medium on which the recording unit is performing image recording. In other words, rather than giving a difference in the circumferential velocity of the two drive rollers that transport the recording medium, tension is given to the recording medium by controlling the torque of the second drive roller. With this kind of constitution, the occurrence of slipping between the drive roller and the recording medium like that described above is suppressed, and it is possible to suppress fluctuation of the tension of the recording medium. As a result, stable transport of the recording medium is realized, making it possible to record an image on the recording medium with high positional precision.

Furthermore, this invention suppresses fluctuation of the tension of the recording medium by controlling the torque of the second drive roller based on the tension detection results of the recording medium. Particularly with this kind of constitution, it is possible to effectively suppress tension fluctuation of the recording medium from the tension detection position to the second drive roller which is controlled by these detection results. In light of this, this invention has the recording medium supported by the support member between the tension detection position and the second drive roller, liquid is ejected on the recording medium supported on this support member, and an image is recorded. Therefore, it is possible to effectively suppress tension fluctuation, and to record an image on the recording medium that is being stably transported, making it possible to record an image on the recording medium with high positional precision.

It is also possible to further equip a driven roller that winds the recording medium that moves from the first drive roller toward the support member, and to constitute the image recording device such that a detection unit is provided on the driven roller. A constitution for which the tension of the recording medium is detected by the detection unit provided in the driven roller in this way is preferable because it is able to detect the tension of the recording medium while suppressing the effect of the tension detection operation on the transport of the recording medium.

It is particularly preferable to apply the invention to a constitution which is an image recording device for which the recording unit ejects as the liquid a photo curing ink that is cured by light, and that is further equipped with a light radiating unit that radiates light on the ink ejected onto the recording medium from the recording unit. In other words, this kind of photo curing ink generates heat along with the curing reaction, and also generates heat by absorbing light. Therefore, on the recording medium, the temperature of the ink adhered part is higher than the temperature of the other parts. As a result, a tension distribution occurs for which there is a difference in the tension between the high temperature parts and the low temperature parts, and there are cases when this tension distribution becomes a cause of wrinkles in the recording medium. In contrast to this, if this invention is applied, it is possible to give stable tension to the recording medium, so it is possible to suppress this kind of wrinkle occurrence.

Also, it is particularly preferable to use the invention for a constitution with which, by further equipping a take up roller that takes up the recording medium which is fed from the second drive roller, the control unit reduces the tension of the recording medium when taken up on the take up roller in accordance with the increase in volume of the recording medium taken up on the take up roller by controlling the torque of the take up roller. In other words, when the tension of the recording medium is reduced when taking it up on the take up roller in this way, there are cases when there is an effect by this tension reduction, and the tension of the recording medium undergoing image recording fluctuates. In light of that, it is preferable to use this invention to effectively suppress this kind of tension fluctuation of the recording medium. By doing this, stable transport of the recording medium is realized, and it is possible to record an image on the recording medium with high positional precision.

It is also possible to have a constitution for which the support member is a drum that winds the recording medium and rotates by receiving the frictional force with the recording medium transported by the transport unit. With this kind of constitution, the drum that supports the recording medium rotates following the transported recording medium. Therefore, it is beneficial for suppressing the occurrence of slipping between the recording medium and the drum, and for stabilizing the tension of the recording medium.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
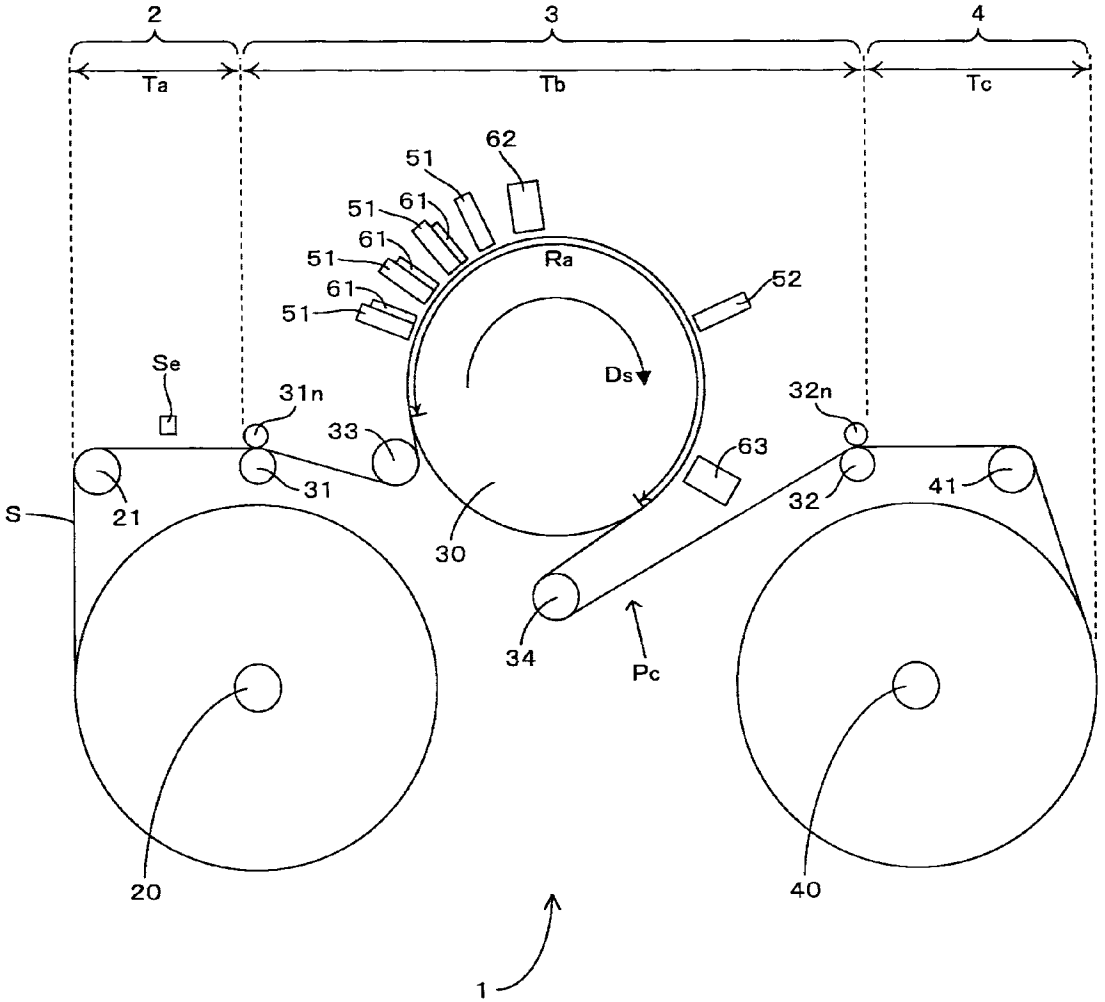
FIG. 1 is a drawing schematically showing an example of the constitution of a device equipped with a printer to which the invention can be applied.

FIG. 1 is a front view schematically showing an example of the constitution of a device equipped with a printer to which the invention can be applied. As shown in FIG. 1, with a printer 1, one sheet S (web), for which both ends are wound into a roll on a feed shaft 20 and a take up shaft 40, is stretched between the feed shaft 20 and the take up shaft 40, and the sheet S is transported from the feed shaft 20 to the take up shaft 40 along the path Pc on which it is stretched in this way. Then, with the printer 1, an image is recorded on this sheet S that is transported along the transport path Pc. The types of sheet S are roughly divided into paper and film. Specific examples include high quality paper, cast paper, art paper, coated paper and the like for the paper type, and synthetic paper, PET (Polyethylene terephthalate), PP (polypropylene) and the like for the film type. Schematically, the printer 1 is equipped with a feed unit 2 that feeds the sheet S from the feed shaft 20, a process unit 3 that records images on the sheet S fed from the feed unit 2, and a take up unit 4 that takes up the sheet S on which the image is recorded by the process unit 3 onto the take up shaft 40. With the description below, of both surfaces of sheet S, while the surface on which the image is recorded is called the front surface, the reverse side surface is called the back surface.

The feed unit 2 has a feed shaft 20 onto which an end of the sheet S is wound, and a driven roller 21 onto which the sheet S pulled from the feed shaft 20 is wound. The feed shaft 20 is in a state for which the front surface of the sheet S faces the outside, and an end of the sheet S is wound on and supported. Then, by the feed shaft 20 rotating clockwise in FIG. 1, the sheet S that was wound on the feed shaft 20 is fed to the process unit 3 via the driven roller 21. Incidentally, the sheet S is wound on the feed shaft 20 via a freely detachable core tube (not illustrated) on the feed shaft 20. Therefore, when the sheet S of the feed shaft 20 is used up, a new core tube on which a rolled sheet S is wound is mounted on the feed shaft 20, and it is possible to replace the sheet S of the feed shaft 20.

The process unit 3 is an item that performs processing as appropriate using each functional unit 51, 52, 61, 62, and 63 arranged along the outer circumference surface of a platen drum 30 while supporting the sheet S fed from the feed shaft 2 on the platen drum 30 to record an image on the sheet S. With this process unit 3, a front drive roller 31 and a rear drive roller 32 are provided at both sides of the platen drum 30, and the sheet S fed from the front drive roller 31 to the rear drive roller 32 is supported on the platen drum 30 and undergoes image recording.

The front drive roller 31 has a plurality of tiny projections formed by thermal spraying on the outer circumference surface, and the sheet S fed from the feed unit 2 is wound from the rear surface side. Then, by the front drive roller 31 rotating clockwise in FIG. 1, the sheet S fed from the feed unit 2 is fed to the downstream side of the transport path. A nip roller 31*n* is provided on the front drive roller 31. This nip roller 31*n* abuts the front surface of the sheet S in a state biased to the front drive roller 31 side, and the sheet S is sandwiched between it and the front drive roller 31. By doing this, frictional force between the front drive roller 31 and the sheet S is ensured, and it is possible to reliably transport the sheet S using the front drive roller 31.

The platen drum 30 is a cylindrical shaped drum supported to be able to rotate freely by a support mechanism that is not illustrated, and the sheet S transported from the front drive roller 31 to the rear drive roller 32 is wound from the rear surface side. This platen drum 30 is an item that supports the sheet S from the rear surface side while receiving the frictional force with the sheet S and being driven and rotated in the sheet S transport direction Ds. Incidentally, with the process unit 3, driven rollers 33 and 34 that turn back the sheet S are provided at both sides of the wind up unit to the platen drum 30. Of these, the driven roller 33 winds the front surface of the sheet S between the front drive roller 31 and the platen drum 30, and turns back the sheet S. Meanwhile, the driven roller 34 winds the front surface of the sheet S between the platen drum 30 and the rear drive roller 32 and turns back the sheet S. In this way, by turning back the sheet S respectively in the upstream and downstream side of the transport direction Ds in relation to the platen drum 30, it is possible to ensure a long winding part of the sheet S to the platen drum 30.

The rear drive roller 32 has a plurality of tiny projections formed by thermal spraying on the outer circumference surface, and the sheet S transported from the platen drum 30 via the driven roller 34 is wound from the rear surface side. Then, by rotating the rear drive roller 32 in the clockwise direction in FIG. 1, the sheet S is transported to the take up unit 4. A nip roller 32*n* is provided on the rear drive roller 32. This nip roller 32*n* abuts the front surface of the sheet S in a state biased toward the rear drive roller 32 side, and the sheet S is sandwiched between it and the rear drive roller 32. By doing this, frictional force is ensured between the rear drive roller 32 and the sheet S, and it is possible to reliably perform transport of the sheet S by the rear drive roller 32.

In this way, the sheet S transported from the front drive roller 31 to the rear drive roller 32 is supported on the outer circumference surface of the platen drum 30. Then, with the process unit 3, to record color images on the front surface of the sheet S supported on the platen drum 30, a plurality of recording heads 51 corresponding to mutually different colors are provided. In specific terms, four recording heads 51 corresponding to yellow, cyan, magenta, and black are aligned in this color sequence in the transport direction Ds. Each recording head 51 faces opposite a slight clearance opened in relation to the front surface of the sheet S wound on the platen drum 30, and ink of the corresponding color is ejected using the inkjet method. Then, by each recording head 51 ejecting ink on the sheet S transported in the transport direction Ds, a color image is formed on the front surface of the sheet S.

Incidentally, as ink, a UV (ultraviolet) ink (photo curing ink) that is cured by the irradiation of ultraviolet rays (light) is used. In light of that, with the process unit 3, to cure the ink and fix it on the sheet S, UV lamps 61 and 62 (light radiating units) are provided. This ink curing is executed divided into two stages, preliminary curing and main curing. In each space between the plurality of recording heads 51 is arranged a UV lamp 61 for preliminary curing. In other words, by radiating weak ultraviolet waves, the UV lamps 61 cure (preliminary curing) the ink to the degree that the ink shape will not break down, but do not completely cure the ink. Meanwhile, at the downstream side in the transport direction Ds to the plurality of recording heads 51, the UV lamp 62 for main curing is provided. In other words, the UV lamp 62, by radiating stronger ultraviolet rays than those of the UV lamps 61, does complete curing (main curing) of the ink. By doing preliminary curing and main curing in this way, it is possible to fix the color image formed by the plurality of recording heads 51 on the front surface of the sheet S.

Furthermore, a recording head 52 is provided at the downstream side of the transport direction Ds in relation to the UV lamp 62. This recording head 52 faces opposite a slight clearance left open in relation to the front surface of the sheet S wound on the platen drum 30, and ejects transparent UV ink on the front surface of the sheet S using the inkjet method. In other words, transparent ink is further ejected on the color image formed by the four colors of recording heads 51. Also, a UV lamp 63 is provided downstream in the transport direction Ds in relation to the recording head 52. This UV lamp 63 radiates strong ultraviolet rays to completely cure (main cure) the transparent ink ejected by the recording head 52. By doing this, it is possible to fix the transparent ink to the front surface of the sheet S.

In this way, with the process unit 3, the platen drum 30 winds and supports the sheet S on its outer circumference surface. Then, in relation to the winding part Ra of the platen drum 30 which winds the sheet S, each functional unit of the recording heads 51 and 52 and the UV lamps 61, 62, and 63 face opposite sandwiching the sheet S, and ejecting of ink on the front surface of the sheet S wound on the winding part Ra and curing are executed as appropriate. By doing this, a color image coated with transparent ink is formed. Then, the sheet S on which this color image is formed is transported to the take up unit 4 by the rear drive roller 32.

The take up unit 4, in addition to the take up shaft 40 on which an end of the sheet S is wound, also has a driven roller 41 on which the sheet S is wound from the rear surface side between the take up shaft 40 and the rear drive roller 32. The take up shaft 40 winds and supports an end of the sheet S in a state with the front surface of the sheet S facing the outside. In other words, when the take up shaft 40 is rotated in the clockwise direction in FIG. 1, the sheet S transported from the rear drive roller 32 is taken up on the take up shaft 40 via the driven roller 41. Incidentally, the sheet S is taken up on the take up shaft 40 via the freely detachable core tube (not illustrated) on the take up shaft 40. Therefore, when the sheet S taken up on the take up shaft 40 is full, it is possible to remove the sheet S for each core tube.

Figure 2:
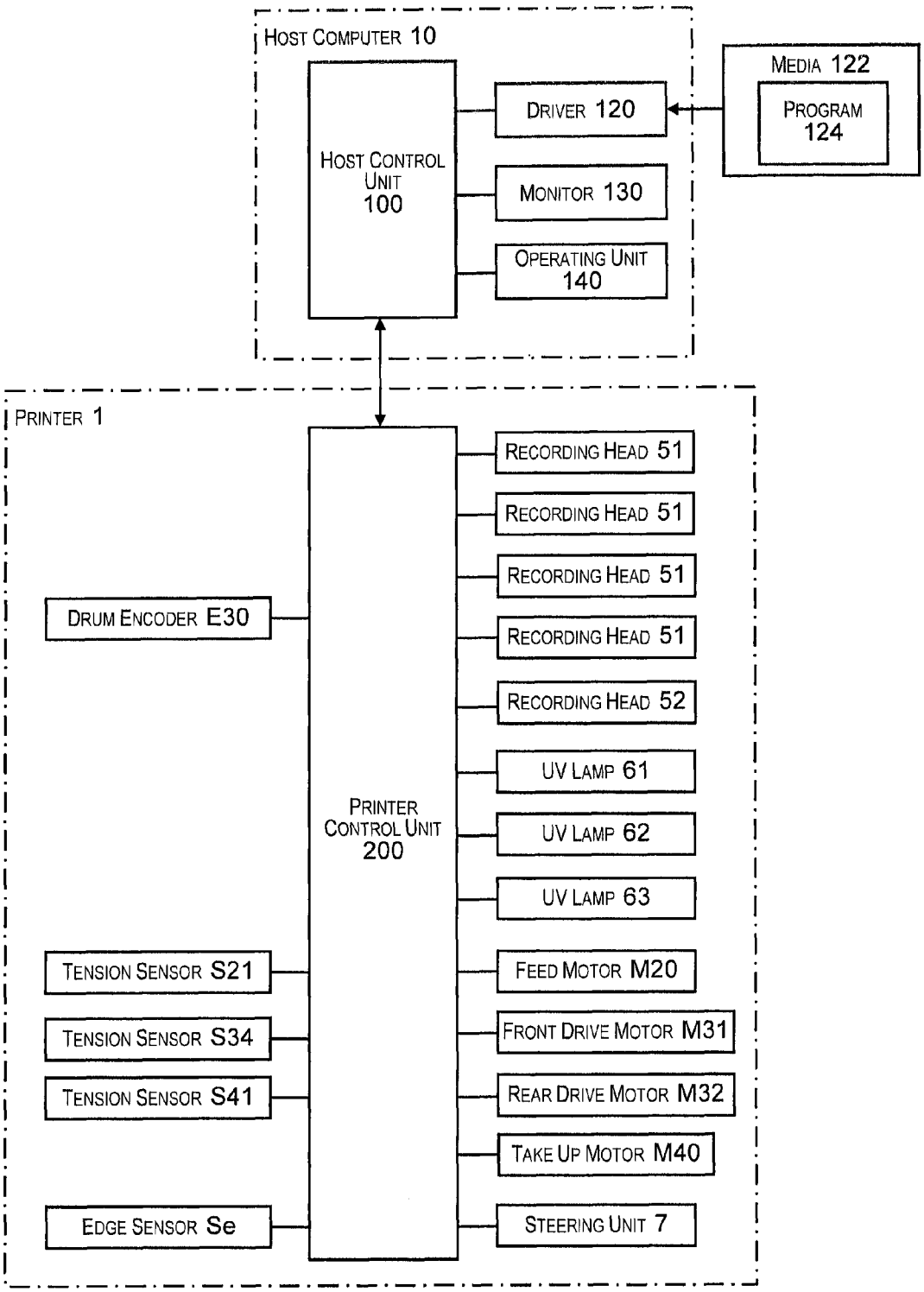
FIG. 2 is a drawing schematically showing the electrical configuration for controlling the printer shown in FIG. 1.

The above is a summary of the device constitution of the printer 1. Following, we will describe the electrical configuration for controlling the printer 1. FIG. 2 is a block diagram schematically showing the electrical configuration for controlling the printer shown in FIG. 1. The operation of the printer 1 described above is controlled by the host computer 10 shown in FIG. 2. With the host computer 10, the host control unit 100 that presides over the control operations is constituted by a CPU (Central Processing Unit) and memory. Also, a driver 120 is provided on the host computer 10, and this driver 120 reads a program 124 from media 122. As the media 122, it is possible to use various items such as a CD (Compact Disk), a DVD (Digital Versatile Disk), USB (Universal Serial Bus) memory or the like. Then, the host control unit 100 performs control of each part of the host computer 10 or control of the operation of the printer 1 based on the program 124 read from the media 122.

Furthermore, as the interface for the worker with the host computer 10, a monitor 130 constituted by a liquid crystal display or the like and an operating unit 140 constituted by a keyboard, mouse or the like are provided. In addition to the printed subject image, a menu screen is also displayed on the monitor 130. Therefore, by the worker operating the operating unit 140 while confirming the monitor 130, it is possible to open the print setting screen from the menu screen, and to set various printing conditions such as the type of printing medium, the printing medium size, the print quality and the like. Various modifications of the specific configuration of the interface with the worker are possible, and for example a touch panel display can be used as the monitor 130, and the operating unit 140 can be constituted using the touch panel of this monitor 130.

Meanwhile, with the printer 1, a printer control unit 200 is provided that controls each part of the printer 1 according to instructions from the host computer 10. Then, the recording heads, the UV lamps, and each part of the sheet transporting device are controlled by the printer control unit 200. The details of the control of the printer control unit 200 on each of these device parts are as follows.

The printer control unit 200 controls the ink ejection timing of each recording head 51 that forms the color image according to the transporting of the sheet S. In specific terms, the control of this ink ejection timing is executed based on the output (detection value) of a drum encoder E30 that is attached to the rotation shaft of the platen drum 30 and detects the rotation position of the platen drum 30. In other words, the platen drum 30 does driven rotation according to the transport of the sheet S, so if the output of the drum encoder E30 that detects the rotation position of the platen drum 30 is referenced, it is possible to find out the transport position of the sheet S. In light of this, the printer control unit 200 generates a pts (print timing signal) signal from the output of the drum encoder E30, and by controlling the ink ejection timing of each recording head 51 based on this pts signal, has the ink ejected by each recording head 51 impact the target position of the transported sheet S to form a color image.

Also, the timing of ejecting transparent ink by the recording head 52 is similarly controlled by the printer control unit 200 based on the output of the drum encoder E30. By doing this, it is possible to appropriately eject transparent ink on the color image formed by the plurality of recording heads 51. Furthermore, the on and off timing and the radiated light volume of the UV lamps 61, 62, and 63 are also controlled by the printer control unit 200.

Also, the printer control unit 200 is in charge of the function of controlling the transport of the sheet S described in detail using FIG. 1. In other words, of the members constituting the sheet transport system, the feed shaft 20, the front drive roller 31, the rear drive roller 32, and the take up shaft 40 respectively have a motor connected to them. Then, the printer control unit 200 controls the speed and torque of each motor while rotating these motors, and controls the transport of the sheet S. The details of this sheet S transport control are as follows.

The printer control unit 200 rotates a feed motor M20 for driving the feed shaft 20, and supplies the sheet S from the feed shaft 20 to the front drive roller 31. At this time, the printer control unit 200 controls the torque of the feed motor M20, and adjusts the tension of the sheet S from the feed shaft 20 to the front drive roller 31 (feed tension Ta). In other words, a tension sensor S21 for detecting the feed tension Ta is attached to the driven roller 21 arranged between the feed shaft 20 and the front drive roller 31. This tension sensor S21 can be constituted by load cells for detecting the force received from the sheet S, for example. Then, the printer control unit 200 does feedback control of the torque of the feed motor M20 based on the detection results of the tension sensor S21, and adjusts the feed tension Ta of the sheet S.

At this time, the printer control unit 200 feeds the sheet S while adjusting the position in the width direction (orthogonal direction to the paper surface in FIG. 1) of the sheet S being supplied from the feed shaft 20 to the front drive roller 31. In other words, a steering unit 7 for which the feed shaft 20 and the driven roller 21 are respectively displaced in the axis direction (in other words, the width direction of the sheet S) is provided on the printer 1. Also, an edge sensor Se that detects the edge in the sheet S width direction is arranged between the driven roller 21 and the front drive roller 31. This edge sensor Se can be constituted using a distance sensor such as an ultrasonic sensor, for example. Then, the printer control unit 200 does feedback control of the steering unit 7 based on the detection results of the edge sensor Se and adjusts the position in the sheet S width direction. By doing this, the position in the sheet S width direction is made to be appropriate, and transport failure such as meandering of the sheet S or the like is suppressed.

Also, the printer control unit 200 rotates a front drive motor M31 for driving the front drive roller 31 and a rear drive motor M32 for driving the rear drive roller 32. By doing this, the sheet S fed from the feed unit 2 passes through the process unit 3. At this time, while speed control is executed on the front driver motor M31, torque control is executed on the rear drive motor M32. In other words, the printer control unit 200 adjusts the rotation speed of the front drive motor M31 to be constant based on the encoder output of the front drive motor M31. By doing this, the sheet S is transported at a constant speed by the front drive roller 31.

Meanwhile, the printer control unit 200 controls the torque of the rear drive motor M32 and adjusts the tension (process tension Tb) of the sheet S from the front drive roller 31 to the rear drive roller 32. In other words, a tension sensor S33 that detects the process tension Tb is attached to the driven roller 33 arranged between the front drive roller 31 and the platen drum 30 on the transport path Pc. This tension sensor S33 can be constituted by a load cell for detecting the force received from the sheet S, for example. In this way, using the tension sensor S33, the tension of the sheet S moving from the front drive roller 31 toward the platen drum 30 is detected. Then, the printer control unit 200 does feedback control of the torque of the rear drive motor M32 based on the detection results of the tension sensor S33 and adjusts the sheet S process tension Tb.

In this way, the tension of the sheet S is detected at the position of the driven roller 33 arranged on the transport path Pc between the front drive roller 31 and the rear drive roller 32. Then, the torque of the rear drive roller 32 is controlled based on these detection results. By doing this, it is possible to give stable process tension Tb to the sheet S from the driven roller 33 to the rear drive roller 32. Then, an image is recorded on the surface of the sheet S supported by the platen drum 30 arranged on the transport path Pc between the driven roller 33 and the rear drive roller 32. Therefore, it is possible to record an image on the sheet S for which the tension is stable.

Also, the printer control unit 200 rotates the take up motor M40 that drives the take up shaft 40, and the sheet S transported by the rear drive roller 32 is taken up on the take up shaft 40. At this time, the printer control unit 200 controls the torque of the take up motor M40, and adjusts the tension (take up tension Tc) of the sheet S from the rear drive roller 32 to the take up shaft 40. In other words, a tension sensor S41 that detects the take up tension Tc is attached to the driven roller 41 arranged between the rear drive roller 32 and the take up shaft 40. The tension sensor S41 can be constituted using a load cell that detects the force received from the sheet S, for example. Then, the printer control unit 200 does feedback control of the torque of the take up motor M40 based on the detection results of the tension sensor S41 and adjusts the take up tension Tc of the sheet S. In specific terms, the printer control unit 200 reduces the take up tension Tc in accordance with the increase in roll diameter consisting of the sheet S taken up on the take up shaft 40. By doing this, as the roll diameter increases, it is possible to control so that the pressure of the sheet S does not become excessive near the roll center, and that the sheet S is not damaged.

As described above, with this embodiment, by rotating the front drive roller 31 and the rear drive roller 32 on which the sheet S is stretched, the sheet S is transported from the front drive roller 31 to the rear drive roller 32. Then, by controlling the torque of the rear drive roller 32, tension is given to the sheet S for which the recording heads 51 and 52 perform image recording. In other words, by controlling the torque of the rear drive roller 32 rather than giving a circumferential velocity difference to the two drive rollers 31 and 32 that transport the sheet S, tension is given to the sheet S. With this kind of constitution, it is possible to suppress the occurrence of slipping between the drive rollers 31 and 32 and the sheet S, and to suppress tension fluctuation of the sheet S. As a result, stable transport of the sheet S is realized, and it is possible to record an image on the sheet S with high positional precision.

Furthermore, with this embodiment, tension fluctuation of the sheet S is suppressed by controlling the torque of the rear drive roller 32 based on the detection results of the tension of the sheet S. In particular with this kind of constitution, it is possible to effectively suppress tension fluctuation of the sheet S from the tension detection position (driven roller 33 position) to the rear drive roller 32 which is controlled by these detection results. In light of that, with this embodiment, the sheet S is supported by the platen drum 30 from the tension detection position (driven roller 33 position) to the rear drive roller 32, and ink is ejected and an image is recorded on the sheet S supported on this platen drum 30. Therefore, tension fluctuation is effectively suppressed, and it is possible to record an image on the sheet S that is transported stably, making it possible to record images on the sheet S with high positional precision.

As with this embodiment, it is particularly preferable to use the invention for a constitution with which UV ink that is cured by ultraviolet rays is ejected on the sheet S, and the ink impacted on the sheet S is cured using ultraviolet ray radiation. In other words, the ink cured using ultraviolet ray radiation in this way generates heat with the curing reaction, and also generates heat by the ultraviolet rays being absorbed. Therefore, on the sheet S, the temperature of the ink adhered parts is higher than the temperature of the other parts. As a result, tension distribution occurs for which there is a tension difference between the high temperature parts and the low temperature parts, and this tension distribution is sometimes the cause of wrinkles in the sheet S. In contrast to that, by using this application, it is possible to give stable tension to the sheet S, making it possible to suppress the occurrence of this kind of wrinkle.

Also, as with this embodiment, it is particularly preferable to use the invention on a constitution for which the tension (take up tension Tc) of the sheet S is reduced when it is taken up on the take up shaft 40 in accordance with an increase in the volume of the sheet S take up on the take up sheet 40. In other words, when the tension is reduced in this way when taking up on the take up shaft 40, there are cases when is an effect by this tension reduction, and the tension of the sheet S undergoing image recording (process tension Tb) fluctuates. In light of that, it is preferable to use this invention to effectively suppress this kind of fluctuation of the process tension Tb of the sheet S. By doing this, stable transport of the sheet S is realized, and it is possible to record images on the sheet S with high positional precision.

Also, with this embodiment, a tension sensor S33 is provided on the driven roller 33 that winds the sheet S. A constitution that detects the tension of the sheet S using the tension sensor S33 provided on the driven roller 33 in this way is able to detect the tension of the sheet S while suppressing the effect of the tension detection operation on the transport of the sheet S, which is preferable.

Also, with this embodiment, the sheet S is supported on the platen drum on which the sheet S is wound, and that receives the frictional force with the transported sheet S and rotates. With this kind of constitution, the platen drum 30 that supports the sheet S rotates following the transported sheet S. Therefore, the occurrence of slipping between the sheet S and the platen drum 30 is suppressed, and this is advantageous for stabilizing tension of the sheet S.

Other

As described above, with the embodiments noted above, the printer 1 correlates to the "image recording device" of the invention, the sheet S correlates to the "recording medium" of the invention, the ink correlates to the "liquid" of the invention, the front drive roller 31 correlates to the "first drive roller" of the invention, the rear drive roller 32 correlates to the "second drive roller" of the invention, the front drive roller 31 and the rear drive roller 32 working jointly function as the "transport unit" of the invention, the platen drum 30 correlates to the "support member" of the invention, the tension sensor S33 correlates to the "detection unit" of the invention, and the printer control unit 200 correlates to the "control unit" of the invention. Also, with the embodiments noted above, the UV ink correlates to the "photo curing ink" of the invention, the take up shaft 40 correlates to the "take up roller" of the invention, the UV lamps 61, 62, and 63 correlate to the "light irradiating unit" of the invention, the driven roller 33 correlates to the "driven roller" of the invention, and the platen drum 30 correlates to the "drum" of the invention.

The invention is not limited to the embodiments noted above, but can also have various modifications added to the item described above as long as it does not stray from the gist. For example, with the embodiments noted above, the transparent ink recording head 52 and the UV lamp 63 were provided. However, the invention can also be applied to a printer 1 that is not equipped with these.

Also, with the embodiments noted above, preliminary curing UV lamps 61 were provided, but it is also possible to constitute the printer 1 without these.

It is also possible to suitably modify the positions for arranging the recording heads 51 and 52 and the UV lamps 61, 62, and 63.

Also, with the embodiments noted above, we explained a case when the invention was applied to a printer 1 which forms color images. However, it is also possible to apply the invention to a printer 1 that forms monochromatic images.

Also, with the embodiments noted above, for example with the aforementioned embodiments, we described a case when the invention was applied to a printer 1 using UV ink. However, it is also possible to apply the invention to a printer 1 using water based ink, for example.

In particular, it is preferable to apply the invention to a constitution for which water based ink on the sheet S is dried by warming the sheet S using an infrared heater. In other words, with this kind of constitution, when warming the sheet S with an infrared heater, a temperature difference occurs between the parts at which the water based ink is adhered and the other parts. Thus, there is a difference in the tension of the high temperature parts and the low temperature parts, tension distribution of the sheet S occurs, and it is easy for wrinkles to occur in the sheet S. In light of that, it is preferable to use this invention to give stable tension to the sheet S so as to effectively suppress the occurrence of this kind of wrinkle in the sheet S.

Also, with the embodiments noted above, the tension of the sheet S was detected by the tension sensor S33 attached to the driven roller 33. However, the specific constitution for detecting the tension of the sheet S is not limited to this. In other words, it is acceptable as long as it is possible to detect the tension of the sheet S from the front drive roller 31 to the platen drum 30.

Also, with the embodiments noted above, the sheet S was supported on the round cylindrical shaped platen drum 30. However, the specific constitution for supporting the sheet S is not limited to the platen drum 30.

What is claimed is:

1. An image recording device comprising:

a transport unit that, by rotating a first drive roller and a second drive roller across which a recording medium is stretched, transports the recording medium from the first drive roller to the second drive roller, a detection unit that detects the tension of the recording medium between the first drive roller and the second drive roller, a support member that supports the recording medium between the detection unit and the second drive roller, a recording unit that ejects a liquid on a recording medium supported on the support member and records an image, and a control unit that gives tension to the recording medium by controlling the torque of the second drive roller based on the tension of the recording medium detected by the detection unit, wherein the tension of the recording medium detected by the detection unit is tension of the recording medium moving toward the support member away from the first drive roller.

2. An image recording device according to claim 1, further comprising a driven roller that winds the recording medium from the first drive roller toward the support member, wherein the detection unit is provided on the driven roller.

3. An image recording device according to claim 1, wherein the recording unit ejects as a liquid a photo curing ink that is cured by light, and the image recording device according to claim 1 further comprises a light radiating unit that radiates light on the ink ejected from the recording unit onto the recording medium.

4. An image recording device according to claim 1, further comprising a take up roller that takes up the recording medium fed from the second drive roller, wherein the control unit reduces the tension of the recording medium when it is taken up on the take up roller in accordance with an increase in the volume of the recording medium taken up on the take up roller, by controlling the torque of the take up roller.

5. An image recording device according to claim 1, wherein the support member is a drum on which the recording medium is wound, and rotates by receiving a frictional force with the recording medium transported by the transport unit.

6. The image recording device according to claim 1, wherein the control unit gives the tension to the recording medium by controlling the torque of the second drive roller while maintaining a circumferential velocity of the first drive roller and a circumferential velocity of the second roller to be substantially the same.

7. An image recording method comprising:

transporting a recording medium supported by a support member from a first drive roller to a second drive roller by rotating the first drive roller and the second drive roller across which the recording medium is stretched;

detecting tension of the recording medium moving toward the support member away from the first driver roller at a detection position between the first drive roller and the second drive roller;

wherein tension is given to the recording medium by controlling the torque of the second drive roller based on the tension of the recording medium at the detection position; and ejecting liquid on the recording medium supported by the support member between the detection position and the second drive roller to record an image.

8. The image recording method according to claim 7, wherein giving the tension to the recording medium includes controlling the torque of the second drive roller while maintaining a circumferential velocity of the first drive roller and a circumferential velocity of the second roller to be substantially the same.

* * * * *